US008851087B2

(12) United States Patent
Gueret

(10) Patent No.: US 8,851,087 B2
(45) **Date of Patent: *Oct. 7, 2014**

(54) APPLICATOR FOR APPLYING A COMPOSITION TO THE EYELASHES

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 854 days.

This patent is subject to a terminal disclaimer.

(21) Appl. No.: 12/078,581

(22) Filed: Apr. 2, 2008

(65) Prior Publication Data

US 2008/0283077 A1 Nov. 20, 2008

Related U.S. Application Data

(60) Provisional application No. 60/913,892, filed on Apr. 25, 2007.

(30) Foreign Application Priority Data

Apr. 2, 2007 (FR) ..... 07 54215

(51) Int. Cl.

| | |
|---|---|
| ***A46B 5/00*** | (2006.01) |
| ***A45D 40/24*** | (2006.01) |
| ***A45D 40/26*** | (2006.01) |
| ***A46B 9/02*** | (2006.01) |

(52) U.S. Cl.

CPC ..... *A46B 5/0062* (2013.01); *A46B 5/0066* (2013.01); *A46B 2200/1053* (2013.01); *A45D 40/24* (2013.01); *A45D 40/265* (2013.01); *A46B 9/025* (2013.01); *A46B 9/021* (2013.01); *A46B 2200/106* (2013.01); *A46B 9/028* (2013.01)

USPC ..... 132/218

(58) Field of Classification Search

USPC ..... 132/218, 320, 317; 401/122, 129, 126, 401/127; 433/147, 141; 15/106

See application file for complete search history.

(56) References Cited

U.S. PATENT DOCUMENTS

| | | | |
|---|---|---|---|
| 508,603 | A | 11/1893 | Danner |
| 2,135,112 | A | 11/1938 | Price |

(Continued)

FOREIGN PATENT DOCUMENTS

| | | |
|---|---|---|
| DE | 202 13 851 | 12/2002 |
| EP | 0 663 161 | 7/1995 |

(Continued)

OTHER PUBLICATIONS

Copending U.S. Appl. No. 12/936,759, filed Oct. 7, 2010.

(Continued)

*Primary Examiner* — Robyn Doan

(74) *Attorney, Agent, or Firm* — Oliff PLC

(57) ABSTRACT

The present invention relates to an applicator for applying a composition to keratinous fibers, the applicator comprising: a stem; a core that extends along a longitudinal axis; applicator elements carried by the core, the distal end of the applicator being defined by the core or by at least one applicator element; the applicator elements defining an envelope surface; wherein the cross-section of the applicator defined by the envelope surface increases, and then decreases, on going towards the distal end of the core along at least two axes that are perpendicular to each other, and defines a peak ridge of maximum radius $r_{max}$ that is strictly the greatest radius for the entire envelope surface, the peak ridge being spaced apart from the distal end of the envelope surface by a distance measured along the longitudinal axis that is less than or equal to 1.5 $r_{max}$; and the angle formed by the slopes of the envelope surface on either side of the peak ridge in at least one longitudinal section being greater than 120°.

41 Claims, 4 Drawing Sheets

(56) References Cited

U.S. PATENT DOCUMENTS

| | | | | | |
|---|---|---|---|---|---|
| 2,245,906 | A | | 6/1941 | Deakers et al. | |
| 3,214,782 | A | * | 11/1965 | Masters et al. | 401/122 |
| 4,030,199 | A | * | 6/1977 | Russell | 433/147 |
| 4,545,393 | A | | 10/1985 | Gueret et al. | |
| 4,586,520 | A | | 5/1986 | Brittain | |
| 4,889,228 | A | * | 12/1989 | Gueret | 206/209 |
| 4,922,936 | A | * | 5/1990 | Buzzi et al. | 132/321 |
| 4,982,838 | A | | 1/1991 | Fitjer | |
| 5,226,744 | A | | 7/1993 | Kemmerer | |
| 5,357,987 | A | | 10/1994 | Schrepf | |
| 5,418,999 | A | | 5/1995 | Smith | |
| 5,542,439 | A | | 8/1996 | Gueret | |
| 5,595,198 | A | | 1/1997 | Kemmerer | |
| 5,716,150 | A | * | 2/1998 | Gueret | 401/129 |
| 5,853,011 | A | | 12/1998 | Gueret | |
| 5,876,138 | A | | 3/1999 | Gueret | |
| 5,918,994 | A | | 7/1999 | Gueret | |
| 5,989,229 | A | * | 11/1999 | Chiappetta | 604/263 |
| 6,082,999 | A | * | 7/2000 | Tcherny et al. | 433/80 |
| 6,158,912 | A | | 12/2000 | Miraglia et al. | |
| 6,572,296 | B2 | | 6/2003 | Schrepf | |
| 7,044,142 | B2 | | 5/2006 | Gueret | |
| 7,125,188 | B2 | | 10/2006 | Gueret | |
| 7,261,483 | B2 | | 8/2007 | Gueret | |
| 7,686,528 | B2 | | 3/2010 | Gueret | |
| 2001/0052348 | A1 | | 12/2001 | Fischer et al. | |
| 2002/0139385 | A1 | * | 10/2002 | Gueret | 132/218 |
| 2002/0182409 | A1 | | 12/2002 | Gueret | |
| 2004/0018037 | A1 | | 1/2004 | Gueret | |
| 2004/0028455 | A1 | | 2/2004 | Petit | |
| 2004/0031114 | A1 | * | 2/2004 | Dragan et al. | 15/106 |
| 2004/0134507 | A1 | | 7/2004 | Gueret | |
| 2005/0232681 | A1 | | 10/2005 | Gueret | |
| 2006/0093425 | A1 | | 5/2006 | Gueret | |
| 2006/0182486 | A1 | | 8/2006 | Habatjou | |
| 2008/0060669 | A1 | | 3/2008 | Malvar et al. | |
| 2008/0202546 | A1 | | 8/2008 | Keurinck | |
| 2008/0251093 | A1 | | 10/2008 | Gueret | |
| 2008/0283077 | A1 | | 11/2008 | Gueret | |
| 2008/0286030 | A1 | * | 11/2008 | Roder | 401/129 |
| 2009/0226238 | A1 | | 9/2009 | Lane et al. | |
| 2010/0189491 | A1 | | 7/2010 | Gueret | |

FOREIGN PATENT DOCUMENTS

| | | |
|---|---|---|
| EP | 0 728 427 | 8/1996 |
| EP | 0 808 587 | 11/1997 |
| EP | 1 384 417 | 1/2004 |
| EP | 1 459 647 | 9/2004 |
| EP | 1 584 260 | 10/2005 |
| EP | 1 649 777 | 4/2006 |
| EP | 1 690 466 | 8/2006 |
| FR | 2 506 581 | 12/1982 |
| FR | 2 715 038 | 7/1995 |
| FR | 2 840 166 | 12/2003 |
| FR | 2 906 115 | 3/2008 |
| FR | 2 906 116 | 3/2008 |
| GB | 2 170 996 | 8/1986 |
| GB | 2 432 513 | 5/2007 |
| JP | 2002-172019 | 6/2002 |
| WO | WO 2006/111645 | 10/2006 |
| WO | WO 2009/125345 | 10/2009 |

OTHER PUBLICATIONS

International Search Report for PCT/IB2009/52612, dated Nov. 5, 2009.
English language Abstract of DE 202 13 851, dated Dec. 19, 2002.
English language Abstract of EP 1 384 417, dated Jan. 28, 2004.
English language Abstract of FR 2 906 115, dated Mar. 28, 2008.
English language Abstract of JP 2002-172019, dated Jun. 18, 2002.
Co-pending U.S. Appl. No. 12/078,582, filed Apr. 2, 2008.
European Search Report for European Application No. 08 15 3972, dated Jul. 7, 2008, corresponding to U.S. Appl. No. 12/078,582.
European Search Report for European Application No. 08 15 3974, dated Jul. 7, 2008, corresponding to U.S. Appl. No. 12/078,581.
French Search Report for French Patent Application No. 07/54214, dated Dec. 12, 2007, corresponding to U.S. Appl. No. 12/078,582.
French Search Report for French Patent Application No. 07/54215, dated Dec. 20, 2007, corresponding to U.S. Appl. No. 12/078,581.
Office Action mailed Feb. 15, 2011, in co-pending U.S. Appl. No. 12/078,582.
Office Action mailed Oct. 8, 2010, in co-pending U.S. Appl. No. 12/078,582 (5 pages).
Office Action mailed Jul. 14, 2011, in co-pending U.S. Appl. No. 12/078,582 (14 pages).
Notice of Allowance mailed Oct. 27, 2011, in co-pending U.S. Appl. No. 12/078,582 (6 pages).

* cited by examiner

APPLICATOR FOR APPLYING A COMPOSITION TO THE EYELASHES

This application claims benefit of U.S. Provisional Application No. 60/913,892, filed Apr. 25, 2007, the contents of which are incorporated herein by reference. This application also claims benefit of priority under 35 U.S.C. §119 to French Patent Application No. 07 54215, filed Apr. 2, 2007, the contents of which are also incorporated by reference.

The present invention relates to applying makeup and/or a care product to keratinous fibers such as the eyelashes and/or the eyebrows.

The invention relates more particularly to applicators including a core and applicator elements that are supported by the core, such applicators also being referred to as brushes or combs.

BACKGROUND

The brushes most commonly used for applying mascara to the eyelashes have an envelope surface of generally elongate shape, and seek to make up as many eyelashes as possible simultaneously.

Accessing the eyelashes that are situated at the corners of the eyes remains relatively difficult with such brushes, as does applying makeup to the bottom set of eyelashes, which are generally shorter.

European patent application EP 1 649 777 discloses brushes that are relatively short, having bristles that define an envelope surface that is biconical. The angle defined by the slopes of the envelope surface on either side of the peak ridge is relatively acute, being less than 120°.

Such brushes are more particularly for applying makeup to eyelashes or eyebrow hairs, the applicator being used with the stem oriented substantially parallel to the set of eyelashes.

U.S. Pat. No. 5,357,987 discloses a brush having two portions of different cross-sections and having corresponding envelope surfaces that are connected together forming a step. One of the portions is more particularly for loading the eyelashes, and the other is for combing them. The portion for combing the eyelashes defines an envelope surface that is off-center and of constant cross-section that extends a fair way from the distal end of the applicator.

U.S. Pat. No. 5,876,138 discloses a brush having a cross-section passing via a minimum, then via a maximum, said maximum being relatively far from the distal end of the applicator.

French patent FR 2 715 038 and European patent EP 0 663 161 disclose brushes having an envelope surface that is biconical with one or more plane faces.

JP 2002-172 019 discloses a brush of constant section, including a twisted core that is provided at its end with a flocked endpiece having a diameter that is less than the diameter of the brush.

EP 1 459 647 discloses brushes including deformed bristles.

US 2008/0060669 disclose flocked applicators.

DE 202 13 851 discloses a mascara brush including bristles that increase in length on moving towards the free end of the brush.

US 2004/018 037 relates to a flocked applicator that does not have a cross-section that increases, and then decreases, along two perpendicular axes.

U.S. Pat. No. 5,853,011 describes a brush including notches extending from a mid-plane. The cross-section of the brush is the same on either side of the notches.

British application No. 2 170 996 describes a brush including a succession of grooves. Its cross-section passes via a maximum that is substantially mid-way along the envelope surface.

FR 2 906 115 discloses a spherical applicator. This citation is not an admission that the contents of the publication is prior art under 35 USC 102.

Application FR 2 506 581 describes an applicator including a core having a plurality of flexible branches that is held between a stem and an adjustment member that is suitable for sliding in the stem. At its end, the adjustment member includes a head that bears against the core and that impedes the applicator from being used other than with the stem oriented substantially tangentially to the set of eyelashes.

SUMMARY

There exists a need to make it easier to apply makeup, and to enable makeup to be applied relatively freely, providing different effects where appropriate.

In one of its aspects amongst others, the invention provides an applicator for applying a composition to keratinous fibers, in particular the eyelashes and/or the eyebrows, the applicator comprising:

a stem;

a core that extends along a longitudinal axis that may be rectilinear or curvilinear;

applicator elements carried by the core, the distal end of the applicator being defined by the core or by at least one applicator element.

In this aspect of the invention:

the cross-section of the applicator defined by the envelope surface increases, and then decreases, on going towards the distal end of the core along at least two axes $X_1$, $X_2$ that are perpendicular to each other, and defines a peak ridge of maximum radius $r_{max}$ that is strictly the greatest radius for the entire envelope surface, the peak ridge being spaced apart from the distal end of the envelope surface by a distance that is preferably less than or equal to 1.5 $r_{max}$, better less than or equal to 1.25 $r_{max}$; and the angle $\alpha$ formed by the slopes of the envelope surface on either side of the peak ridge in at least one longitudinal section is greater than 120°, better greater than 130°, still better greater than 135°.

The term "total length $q_{max}$" should be understood to mean the total length of the envelope surface defined by the applicator elements, measured along the longitudinal axis of the core. For a brush, for example, the total length $q_{max}$ may be the length of the core carrying the bristles.

The distal end of the applicator corresponds to the end point of said applicator, at its free end. The end point of the applicator may be defined by an applicator element or by the core of the applicator.

The angle $\alpha$ is the angle formed by the slopes of the envelope surface on either side of the peak ridge. The slopes may be straight lines that fit as closely as possible to the envelope surface on either side of the peak ridge. They may be tangents to portions of the envelope surface adjacent to the peak ridge, said portions extending over a length, measured along the longitudinal axis of the core, that is equal to 1 millimeter (mm), for example. The slopes may even be straight lines passing through the peak ridge and intersecting the envelope surface at a distance from the peak ridge, measured along the longitudinal axis of the core, that is equal to 1 mm.

Such an applicator makes it possible to act on the eyelashes or on the eyebrows with multiple orientations of the stem relative to the set of eyelashes, by means of the envelope surface having a shape that may, in some embodiments of the invention, define a ball or a similar shape, at least in part, with, for example, an envelope surface length $q_{max}$ measured along the longitudinal axis that is less than or equal to twice the greatest diameter $d_{max}$ of the cross-section of the envelope surface, better with $q_{max} \leq 1.5\ d_{max}$, e.g. $0.75\ d_{max} \leq q_{max} \leq 1.5\ d_{max}$.

By way of example, the multiple orientations may comprise orientations that are 180° apart, or even more, e.g. being more than 300° apart. For an applicator having a twisted core, the eyelashes may be brushed perpendicularly to the turns or in alignment with said turns, for example.

The user could easily choose the orientation and/or the hand movement best suited to achieving the desired makeup effect.

Where appropriate, the user could apply makeup by turning the applicator about its own axis, while moving it in contact with the eyelashes, as if rolling it over them.

For an applicator in which only the distal portion is generally ball shaped, the proximal portion could be used to apply makeup to the eyelashes in the conventional way, and the distal portion could be used for finishing or to apply makeup to the zones that are less accessible. The proximal portion may also perform a role during wiping, e.g. to clean the wiper member, or it may have a function that is purely esthetic.

The applicator may be used on its own, e.g. in order to improve the makeup effect of a composition that has already been applied to the eyelashes or eyebrows, or it may be used after loading the applicator elements with a composition, loading being performed either by depositing the composition on the applicator elements, or by bringing the applicator elements into contact with a cake of composition, or by dipping the applicator into a receptacle containing the composition.

When the applicator is used in association with a receptacle that is provided with a wiper member, the shape of the applicator could result in unequal wiping that could be advantageous for the makeup effect. For example, the zone of greatest diameter of the applicator is wiped more, and is better able to separate and extend the eyelashes. The zone at the end of the applicator could be loaded more heavily with composition, and could be used to apply makeup to groups of eyelashes or eyebrow hairs because of the possibility of using the applicator with multiple orientations.

The invention makes it possible to use the excess composition that is often found at the end of the brush as a result of the non-zero section of the wiper orifice, and that constitutes an impediment with conventional brushes.

The applicator may comprise at least two applicator elements each having a different length.

At least two applicator elements, or even at least three, may extend in at least two different directions from the core, better at least three.

The applicator may comprise a least one applicator element which is non perpendicular to the core.

The core may comprise a portion of the core carrying the applicator elements having an oblong shape, being for example elongated along its longitudinal axis.

The core may extend along a longitudinal axis which is rectilinear or curved. In case the longitudinal axis is curved, its orientation may vary if at least 90°.

In exemplary embodiments, the ratio $R_1 = d_{max}/d_{core}$ is greater than or equal to 2.5 and better greater than or equal to 3. $d_{core}$ corresponds to the diameter in which the cross section of the core is inscribed.

In the case of an applicator having applicator elements moulded with the core, $d_{core}$ satisfies for example $2\ mm \leq d_{core} \leq 3\ mm$, for example $d_{core}$ less than or equal to 2.5 mm and in the case of a twisted wire core brush, for example $0.7\ mm \leq d_{core} \leq 1.8\ mm$, for example $d_{core}$ less than or equal to 1.8 mm.

One as for example $d_{max}$ ranging from 6 to 12 mm, for example ranging from 8 to 9 mm, the applicator members being moulded or the applicator having a twisted wire core.

An applicator with applicator members having relatively great length may enable both a good load with product and a satisfying wiping, allowing a successful application and for example to avoid the contamination of the eyelids.

The longer the applicator member, the lower the risk of contact between the core and the eyelids, such a contact between the core and the eyelids potentially affecting the quality of the make-up.

The generally spherical shape of the applicator may be obtained through a variable length of the applicator members, for example of the bristles, and not to a variation in the diameter of the core that supports them, such a variation being observed along the longitudinal axis of the applicator.

Preferably, the wiping of the applicator is carried out with a wiping member made in elastomer. Such a wiping member is particularly suited to applicators having a moulded core.

Be the applicator with a twisted wire core or moulded core, one may preferably choose a wiping member having a wiping orifice which has a minimum diameter that is greater than or equal to the maximum diameter $d_{stem}$ of the stem of the applicator.

In exemplary embodiments, the ratio $R_2 = d_{max}/d_{stem}$ is greater than or equal to 2.5 and better greater than or equal to 3.

The core may be made such that its external surface extends in the continuity of the external surface of the stem, once the core is fitted on the stem. In this manner, one avoids bead between the core and the stem.

The external diameter $d_{stem}$ of the stem is for example ranging from 2.5 to 3 mm when the core is moulded, and in the case of a twisted wire core brush, the diameter $d_{stem}$ is for example ranging from 2 to 4.5 mm.

The core may be held in a housing of the stem by force fitting, gluing and/or by stamping of the stem on an endpiece made in one piece with the portion of the core carrying the applicator members.

The longitudinal axis of the core may be non entirely situated in the alignment of the longitudinal axis of the stem.

The core of the applicator may extend rectilinearly for example when the core is a twisted wire core. The core, for example in the case of a twisted wire core, may be not folded on itself.

The applicator members may have a cross section, with respect to their longitudinal axis, which is non circular, for example that is polygonal, and the applicator members may have at least one edge and/or at least one planar portion. The later may extend parallel to the longitudinal axis of the applicator or may cross the longitudinal axis of the applicator.

At least some of the applicator member, for example all of them, may have a cross section relatively to there longitudinal axis, which is half circular.

A cross section of the applicator member that is a non circular may increase a load with product and may increase the transfer of the product on the eyelashes, in particular when the applicator members have, as mentioned above, a cross section that presents at least one edge and/or at least one planar portion, for example a cross section that is half circular. Applicator members with cross section that is non circular relative to there longitudinal axis may be made by moulding, in particular when the applicator has a moulded core.

When the applicator comprises a twisted wire core brush, the brush may advantageously be a brush that do not show a visible turn affect, i.e. in which the distribution of the free end of the bristles on the envelop surface of the brush is different from an helical distribution, when observed with the naked-eye.

The brush may comprise for example between 10 and 40 bristles.

The applicator may comprise two twisted wire cores that are twisted together, which may reduce the turn effect.

The core, when it is twisted, may be made with one or more wires that are coated, for example one or more wires which comprise a metal core and a shell of a material other than a metal, for example made of plastic material or a varnish.

The shape or the envelop surface may be obtained, in the case of an applicator having a twisted core, by a cutting of the bristles or by a heat treatment of the bristles, for example a treatment that causes the free end of the bristles to fuse along a predetermined a length.

The fact that the applicator members extend on a length that is relatively short along the longitudinal axis of the applicator may be used to make the stem longer and thus improve the workability of the applicator.

Relative increase of the length of the stem may also enable to improve the loading of the applicator members with product, as they may be displaced along a distance that is greater inside the receptacle before their taking off from the receptacle.

One may obtain a greater proportion of applicator members that have a better load with product, in particular for receptacles which are not initially filled to 100%, which is often the case to avoid suction effect during taking off of the applicator.

The invention may allow to use a receptacle having a depth that is relatively small, for example sample receptacle, without the low depth of the receptacles causes the applicator to be insufficiently loaded with product. For example, $R_3=d_{max}/P_{receptacle}$ may be greater than or equal to 3.

The depth $P_{receptacle}$ of the receptacle is defined has being the distance between the top of the receptacle when the applicator is absent, that is to say the top of the neck of the receptacle, when such a neck exists, and the internal surface of the bottom of the receptacle, the distance being taken along the longitudinal axis of the receptacle.

Preferably, $R_4=d_{max}/d_f$, where $d_f$ is the distance between the internal surface of the bottom of the receptacle and the lower end of the wiper member, is greater than or equal to 3.

The receptacle may be any receptacle and may comprise two parts that are movable one relative to the other, rotation of one part with respect to the other causing the increase of the volume of a chamber defined inside the receptacle between the two parts and the decrease of the volume of another chamber and the flow of product between the two chambers. Such a flow of product may take place trough a central region of the receptacle housing the applicator element Such a receptacle is disclosed for example in the application EP 1 584 260.

The receptacle may be provided with a wiper member which is for example molded in a thermoplastic material, for example an elastomer. Such a wiper member may comprise in its upper part a flange that may lie on top of the neck of the receptacle. In a variant, the wiper member may be a wiper member comprising a block of foam material, for example a foam which may comprise open cells.

The core of the applicator may comprise, for example when it is twisted, a free end. The stem may be fitted to a closing cap which is used as prehension member and the stem may be not made as a single piece with all of the closing cap. The receptacle may be molded in thermoplastic material or may be made in glass or other material.

In embodiments of the invention, the applicator includes a core having a left-handed or right-handed twist, but, in a variant, the core need not be twisted, e.g. being molded with the applicator elements held on the core by adhesive, by crimping, by local melting of material, or by overmolding the core.

The applicator elements may also be integrally molded with the core, e.g. out of an elastomer material, the applicator thus being a comb or an injection-molded brush.

The applicator elements may be bristles, and said bristles may be sufficiently flexible to deform during application, on being loaded with composition, and/or on passing through the optional wiper member. The applicator elements may also be teeth that are relatively stiff.

By way of example, the number of applicator elements lies in the range 100 to 1500, better in the range 160 to 1500, for a brush having a twisted core, and in the range 20 to 500 for a comb or an injection-molded brush.

Each applicator element may present, mid-way along its length, between its base connected to the core and its free end, a cross-section that is inscribed in a circle of diameter lying in the range $^{6}/_{100}$ mm to $^{35}/_{100}$ mm, for example.

The envelope surface may define a cross-section of outline that is circular, at least in part, e.g. of outline that is circular over at least 180° around the core, or even completely circular, at least one point along the length of the core, in particular at its peak ridge, or over at least a fraction of the length of the core, e.g. over the entire length of the portion of the core carrying the bristles.

The cross-section may have a shape factor that is greater than 0.7, at least in the plane where the radius $r_{max}$ is at its maximum. The envelope surface might have no notches or no outwardly-concave face, e.g. in the plane where the radius $r_{max}$ is at its maximum.

The envelope surface may define at least one radius having a length that varies in non-linear manner between the proximal end of the envelope surface and the peak ridge, e.g. varying along an arc of a circle or of any curve other than a straight line. The term "radius" means the line segment leaving the core perpendicularly to its axis and having an end that belongs to the envelope surface.

The envelope surface may define a radius that varies in non-linear manner between the peak ridge and the distal end of the envelope surface, e.g. varying along an arc of a circle.

The envelope surface on one side of the peak ridge, e.g. towards the proximal or distal end of the applicator, need not be conical.

The slope on one side of the peak ridge need not be constant, e.g. increasing in inclination relative to the longitudinal axis towards the distal or proximal end.

The envelope surface may define at least two radii that are parallel to axes $X_1$ and $X_2$ having lengths that vary non-linearly as a function of position along the longitudinal axis, e.g. each along a circular arc on at least one side of the peak ridge.

The envelope surface may increase, and then decrease, over at least 180° around the core, better 270° around the core, e.g. 360° around the core.

The envelope surface, when observed from the side, i.e. perpendicularly to the axis of the core, may present a rounded profile on either side of the peak ridge.

The envelope surface may present a distal portion that is at least partially spherical, e.g. to within 20%, e.g. over a distance of at least 2 mm along the longitudinal axis. In other words, for a spherical surface having a radius $r_{mean}$ measured from a center point, each point of said portion of the envelope surface is situated at a distance from the center point that lies in the range 0.8 $r_{mean}$ to 1.2 $r_{mean}$.

The envelope surface may present a portion of cross-section that varies, containing the peak ridge, and a second portion of cross-section that is constant, the portion of varying cross-section being of length that is less than the length of the portion of constant cross-section. The portion of constant cross-section may be situated at a distance from the peak ridge, along the longitudinal axis.

The length of the portion of varying cross-section may, in particular, be less than or equal to one half of the length of the portion of constant cross-section.

The envelope surface may present a proximal portion that is cylindrical, in particular of circular section.

The core, in particular when it is twisted, may comprise a visible first portion that does not carry any applicator elements and that extends axially between a stem to which the core is connected and a second portion of the core carrying the applicator elements, the length of the first portion being greater than or equal to 5 mm, for example. The length of the second portion carrying the applicator elements lies in the range 6.5 mm to 35 mm, for example. The number of turns in the portion of the core carrying the applicator elements may, for example, be greater than or equal to 7, e.g. lying in the range 7 to 25, e.g. about 20.

The greatest transverse dimension of the envelope surface, e.g. the greatest diameter for a circular section, may be greater than the radius at the proximal and/or distal end by at least the value $r_{max}$, for example.

The distance from a transverse plane containing the above-mentioned peak ridge to the distal end of the applicator may be less than or equal to 12 mm, indeed 10 mm or 8 mm, for example.

The peak ridge may be situated at a distance $r_{max}$ that is greater than or equal to 2.5 mm from the longitudinal axis of the core, e.g. lying in the range 2.5 mm to 7.5 mm, indeed 3 mm to 6 mm from the axis of the core. By way of example, this value may depend on the wire used to make the core, when said core is twisted.

The applicator elements may extend in at least two non-parallel directions, in particular on opposite sides of the core. In particular, the applicator elements may extend in more than four different directions around the core, e.g. being angularly spaced apart by more than 45°.

The portion of the core that does not carry applicator elements may optionally be rectilinear.

The envelope surface may optionally be a surface of revolution.

The portion of the core carrying the applicator elements may optionally be rectilinear.

The stem may include a flexible portion that is suitable for flexing in use, and that is situated between the portion of the stem that is used for connecting to the core, and a portion of the stem that is connected to a handle.

By way of example, the core has an end that is supported by the stem and an opposite end that is free or that carries applicator elements.

The stem may be solid.

The stem may have a fixed length. The length of the stem need not be modifiable by action on an adjustment member. The distance between the end of the stem connected to the core and the handle may be fixed.

In another of its aspects, the invention also provides a packaging and applicator device for applying a composition to keratinous fibers, in particular the eyelashes or the eyebrows, the device comprising:

the composition for application to keratinous fibers; and an applicator as defined above.

The composition may be contained in a receptacle that may include a wiper member for wiping the applicator while it is being removed from the receptacle.

In another of its aspects, the invention also provides a method of applying makeup to the eyelashes and/or the eyebrows, the method comprising the steps consisting in loading the bristles of an applicator with a composition for application to the eyelashes and/or the eyebrows, then in bringing the applicator elements thus loaded with composition into contact with the eyelashes or the eyebrows.

During application, the user may turn the applicator about its own axis, in particular as though said applicator is rolling over the eyelashes towards the tips thereof.

By way of example, the eyelashes may be made up with at least the applicator elements that are situated axially along the core between the peak ridge and the distal end of the applicator.

In another of its aspects, and independently or in combination with the above, the invention also provides an applicator for applying a composition to keratinous fibers, in particular the eyelashes and/or the eyebrows, the applicator comprising:

a stem;

a core that extends along a longitudinal axis; and applicator elements carried by the core, the applicator elements defining an envelope surface that presents a protuberance of substantial spherical shape adjacent to the distal end of the applicator, the protuberance defining a peak ridge.

The term "substantially spherical" should be understood to mean that the protuberance is spherical to within 20%, better to within 15% or even 10%, in particular along its distal portion beyond the peak ridge of the protuberance. The protuberance may be substantially spherical over its entire length measured along the longitudinal axis of the core. The envelope surface may include a cylindrical portion, that may be of circular cross-section, relative to which the protuberance projects. The protuberance may be of circular cross-section, at least at its peak ridge.

In another of its aspects, and independently or in combination with the above, the invention also provides an applicator for applying a composition to the eyelashes and/or the eyebrows, the applicator comprising:

a core that extends along an axis;

a plurality of bristles or teeth that are integrally molded with the core, the bristles or teeth extending in a plurality of directions around the core;

the distal end of the applicator being defined by at least one bristle or tooth; and the bristles or teeth defining an envelope surface having a transverse dimension that increases, and then decreases, from the distal end to the proximal end of the applicator.

In another of its aspects, the invention also provides a packaging and applicator device comprising:

a receptacle provided with a wiper member;

a core; and bristles supported by the core;

at least some bristles having a length and a position on the core enabling them, on flexing while passing through the wiper member while the brush is being removed from the receptacle, to cover the distal end of the brush.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
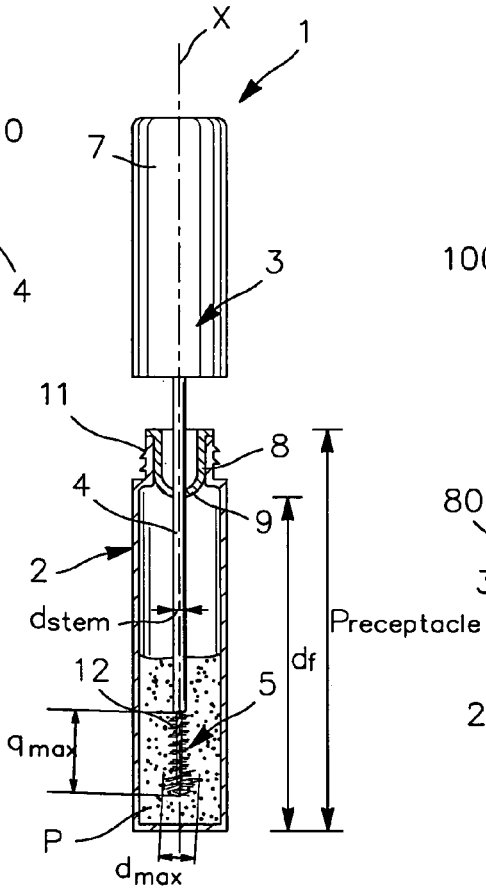
FIG. 1 is a diagrammatic view, in fragmentary longitudinal section, showing an example of a packaging and applicator device constituting an embodiment of the invention.

The packaging and applicator device 1 shown in FIG. 1 comprises a receptacle 2 and an applicator 3 comprising a stem 4 of axis X and of diameter $d_{stem}$, that is provided at one end with a brush 5, and that is connected at its opposite end to a handle 7 that also constitutes a closure member for closing the receptacle 2. The receptacle includes a threaded neck 11 on which the handle 7 can be screwed in leaktight manner, but said receptacle could be made in some other way. $p_{receptacle}$ corresponds to the distance between the top of the neck and the internal surface of the bottom of the receptacle.

A wiper member 8 can be mounted in the neck 11 as shown, and, in the embodiment under consideration, includes a flexible lip 9 for wiping the stem 4 and the brush 5 while being removed from the receptacle 2. $d_f$ corresponds to the distance between the lower end of the wiper member and the internal surface of the bottom of the receptacle.

The receptacle 2 contains a composition P for application to keratinous fibers, in particular the eyelashes or the eyebrows, e.g. mascara.

In the embodiment under consideration, the stem 4 is rectilinear and of circular cross-section, but, in variants not shown, the stem can be non-rectilinear and/or of non-circular section.

The applicator 3 can be fastened on the receptacle 2 other than by screw-fastening, e.g. by snap-fastening.

In the embodiment under consideration, the brush 5 includes a twisted core 10 formed, for example, by a wire folded in a U-shape and twisted in one direction in order to clamp bristles between the turns formed in this way, which bristles may be made of a natural or synthetic material. By way of example, the wire presents a diameter lying in the range 0.35 mm to 1.2 mm, e.g. about 0.45 mm in diameter, with said wire being made of stainless steel, for example. $D_{core}$ corresponds to a diameter in which a cross section of the core is inscribe.

The core 10 extends along a longitudinal axis Y that can optionally be rectilinear, and that can optionally coincide with the longitudinal axis X of the stem 4.

Figure 2A:
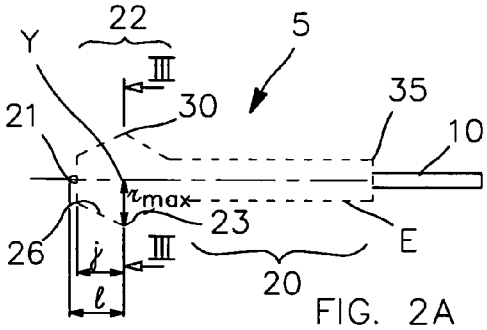
FIGS. 2A and 2B show, in isolation, the envelope surface of the brush of the FIG. 1 device, respectively from the side and in perspective.
Figure 2B:
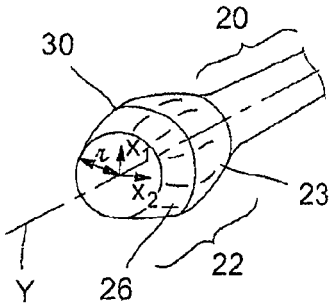

The free ends of the bristles 12 of the brush 5 define an envelope surface E that is represented by a dashed line in FIG. 2A and shown in a diagrammatic perspective view in FIG. 2B.

In the embodiment under consideration, the envelope surface E is a surface of revolution and comprises a first portion 20 that is cylindrical and of constant cross-section, and a second portion 22 of cross-section that varies, e.g. comprising, on going towards the distal end of the core 21, a diverging first surface 23 and a converging second surface 26 that are connected together via an edge 30 defining a peak ridge where the radius r, i.e. the distance from the envelope surface E to the axis Y of the core 10, is at its greatest for the entire envelope surface E.

By way of example, the first surface 23, e.g. a substantially frustoconical surface, makes it possible to pass from an envelope surface diameter that is about 5 mm, for example, to a diameter that is about 7.5 mm, for example, over a distance along the core that lies in the range 7 mm to 8 mm, for example.

By way of example, the second surface 26, e.g. a substantially frustoconical surface, makes it possible to pass from a diameter of about 7.5 mm to a diameter of about 4 mm over a length of about 4 mm.

By way of example, the surfaces 23 and 26 are substantially symmetrical to each other about a mid-plane containing the peak ridge 30.

The length of the portion 22 of section that varies, that forms the protuberance of the brush, lies in the range ⅓ to ⅔ of the length of the portion 20 of section that is constant, for example.

The cross-section of the brush increases, and then decreases, on moving from the proximal end to the distal end of the envelope surface, along at least two axes X1 and X2 that are perpendicular to each other, as shown in FIG. 2B.

In the longitudinal section plane containing the axis X1 that is perpendicular to the axis Y, the radius r increases, reaches the maximum $r_{max}$, and then decreases. The same applies in the longitudinal section plane containing the axis X2. The longitudinal section planes containing the axes X1 and X2 respectively, can be planes of symmetry for the envelope surface.

By way of example, the brush 5 is fabricated from a circularly-cylindrical envelope-surface blank of diameter corresponding to the diameter of the edge 30, by cutting the blank with a cutter having the same profile as the envelope surface in longitudinal section.

In the embodiment under consideration, the distance along the axis Y between the proximal end 53 of the envelope surface E and the free end 21 of the core 10 is about 27 mm, for example, and the distance l from the transverse plane containing the peak ridge 30 to the transverse plane containing the free end 21 of the core is about 5 mm, for example.

The distance j between the transverse plane containing the peak ridge 30 and the distal end of the envelope surface is about 4 mm, for example.

Figure 18:
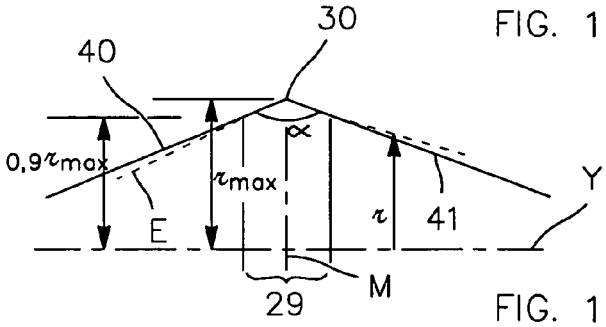
FIG. 18 shows the angle formed at the peak ridge between the slopes of the envelope surface for the FIG. 2 brush.

The angle α formed between the slopes 40 and 41 of the envelope surface that are respectively situated on either side of the peak ridge 30 is greater than 120°, e.g. being about 135° in the embodiment under consideration, as can be seen in FIG. 18.

As shown in FIG. 18, each slope 40 or 41 is defined by the straight line that passes via the peak ridge of the envelope surface E, and that fits as closely as possible to the outline of the envelope surface in a longitudinal-section plane, over a distance of 1 mm along the axis Y, on the corresponding side of the peak ridge.

In the example of a biconical envelope surface, the slopes are respectively the slopes of the two cone portions. In the example of a spherical envelope surface that is symmetrical about the plane containing the peak ridge 30, the angle α is closer to 180°.

In the embodiment under consideration, the shape factor of the brush, in the transverse plane containing the peak ridge 30, is equal to 1, the envelope surface E presenting a circular outline centered on the axis Y of the core 21.

The shape factor is defined by $r_{min}/r_{max}$, where $r_{max}$ designates the greatest radius of the cross-section under consideration, i.e. the greatest distance from the axis Y of the core 10 to the envelope surface E, and $r_{min}$ designates the smallest radius, i.e. the smallest distance from the axis Y of the core 10 to the envelope surface E in the section plane. A square cross-section with a centered core would have a shape factor of $1/\sqrt{2}$.

Figure 7A:
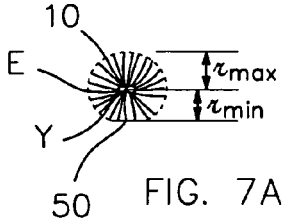
FIGS. 7A and 7B are sections similar to FIG. 3, of variant embodiments.

It is not beyond the ambit of the present invention when the envelope surface E is not a surface of revolution, and when the envelope surface presents, at least one point along the core, a cross-section that is not circular, e.g. because of the presence of at least one facet 50, as shown in FIG. 7A.

Figure 7B:
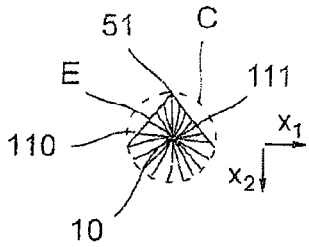

As shown in FIG. 7B, the applicator can also include at least one crest 51 that extends over less than 90°, for example, around the axis Y. The crest 51 can be formed at the junction of two facets 110 and 111 which can, for example, be inscribed in a circle C defining the outline of the portion of the envelope surface opposite from the crest 51.

The two facets 110 and 111 can optionally be symmetrical to each other, and can optionally be plane.

The crest 51 can taper to a greater or lesser extent depending on the inclination of the facets 110 and 111, and can widen to a greater or lesser extent depending on the distance between said facets.

The portion 29 of the envelope surface E that contains the peak ridge 30 and that is at a distance of more than 0.9 times the maximum radius $r_{max}$ has, for example, its middle M substantially coinciding with the peak ridge 30, as can be seen in FIG. 18. The middle M can be situated at a distance from the transverse plane containing the free end 21 of the core 10 that is less than 2.5 times the radius $r_{max}$, better less than 1.5 times the radius $r_{max}$.

In the FIG. 2 embodiment, the radius $r_{max}$ is about 3.75 mm and the distance l between the transverse plane containing the peak ridge 30 and the transverse plane containing the free end 21 of the core is about 5.6 mm.

Figure 4:
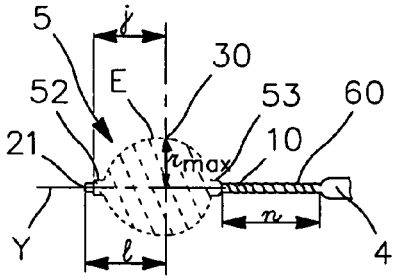
FIG. 4 is a diagram of a variant embodiment of the brush shown in isolation.

In the FIG. 4 embodiment, the entire envelope surface E presents the general shape of a ball, and at least one portion of the envelope surface, better the entire envelope surface, can be substantially spherical to within 20%, in particular the portion situated between the peak ridge 30 and the free end 21 of the core.

The length of the portion of the core carrying the bristles is 12 mm, for example. The greatest diameter is about 10 mm, for example. The diameter of the envelope surface at the distal end and at the proximal end is about 5 mm, for example.

Figure 5:
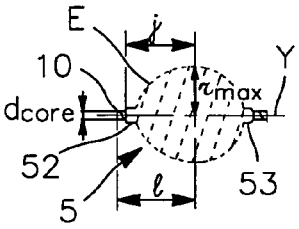
FIG. 5 is a view similar to FIG. 4 showing another variant embodiment.
Figure 3:
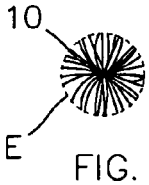
FIG. 3 is a diagrammatic cross-section on III-III of FIG. 2.

The brush can have a left-handed or right-handed twist, as shown in FIGS. 4 and 5.

The core 10 can present a bare portion 60, not carrying bristles, that extends between the stem 4 and the portion of the core carrying the bristles. The bare portion 60 can extend over a distance n of length that can be short or long, e.g. lying in the range 5 mm to 10 mm, or even longer when the portion acts as a stem and replaces the conventional stem made of plastics material.

Figure 6A:
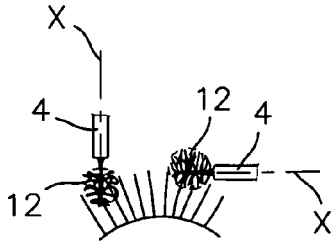
FIGS. 6A and 6B show eyelashes being made up using an applicator constituting an embodiment of the invention.
Figure 6B:
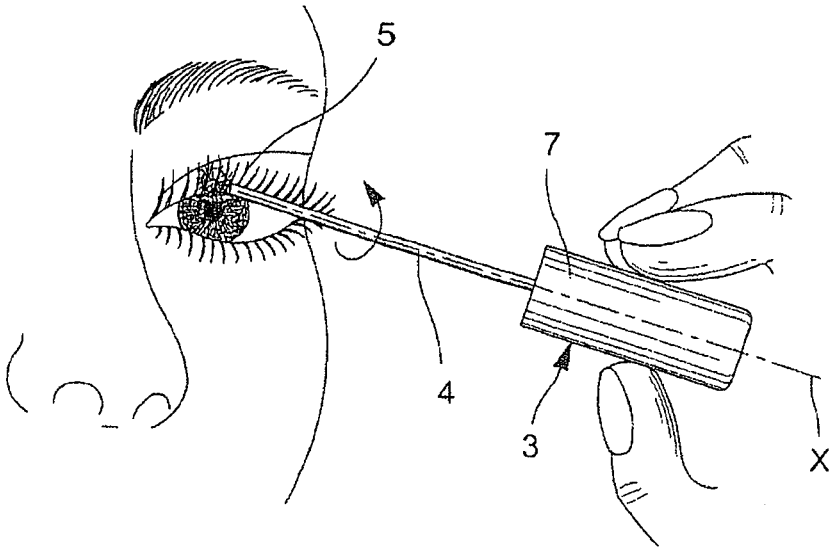

In the invention, the shape of the envelope surface E makes it possible to use the applicator for applying makeup to the eyelashes, in multiple orientations, as shown in FIGS. 6A and 6B.

In particular, for applying makeup, it is possible to use bristles that are situated on the core between the transverse plane where the transverse section is greatest and the free end of the applicator, e.g. by orientating said applicator with the distal end of the stem 4 directed towards the set of eyelashes. In a variant, it is possible to use bristles of the brush that are situated further back, e.g. with the longitudinal axis of the stem being oriented substantially parallel to the set of eyelashes, as shown in FIG. 6A.

While the composition is being applied to the eyelashes, the applicator can be turned about its own axis as though it is rolling in contact with the eyelashes towards their free ends, as shown in FIG. 6B.

The envelope surface E of the brush can present various other shapes without going beyond the ambit of the present invention.

Figure 8:
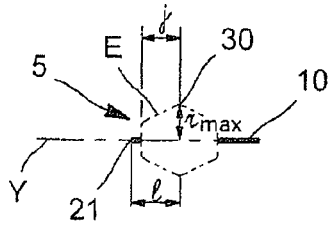
FIGS. 8 to 15 show other variant embodiments of the applicator.

In the embodiment in FIG. 8, the envelope surface presents a substantially biconical shape.

The angle α between the slopes at the peak ridge is however relatively large, so as to resemble the shape of a ball.

The radius r need not decrease to zero at the ends of the envelope surface.

At the distal end, the diameter of the envelope surface in this embodiment, or in other embodiments, is greater than or equal to 4 mm, for example.

Where appropriate, the envelope surface E can be symmetrical on either side of a mid-plane containing the peak ridge 30.

As shown in the embodiments in FIGS. 4 and 5, the envelope surface can present a spherical portion that is extended towards the proximal and distal ends by cylindrical portions 52 and 53 that are relatively short.

Figure 9:
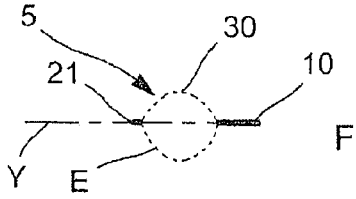

In the embodiment in FIG. 9, the envelope surface E presents a shape in longitudinal section that is generally lens shaped. The cross-section defined by the envelope surface E increases, e.g. from a proximal end where the radius r is substantially zero, until it reaches the peak ridge 30, and then decreases until it reaches an end where the radius r can be substantially zero once again.

The peak ridge 30 can be defined by an edge, as in the embodiments above.

Figure 10:
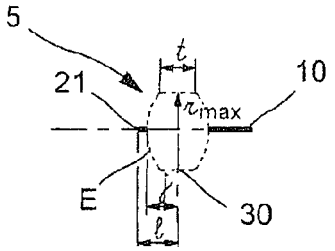

In a variant, the peak ridge 30 can extend flat over a certain distance along the axis Y, as shown in FIG. 10.

In the embodiment in this figure, the envelope surface E defines a maximum cross-section of radius $r_{max}$ over a certain distance t before decreasing towards the free end of the core. By way of example, the middle of this portion of radius $r_{max}$ is situated at a distance l from the free end 21, which distance is such that the ratio $l/r_{max}$ is less than 1.5. The length t is greater than or equal to 1 mm, for example.

The envelope surface E, in particular in the plane where the cross-section is at its maximum, can present a shape that is not circular.

Figure 11:
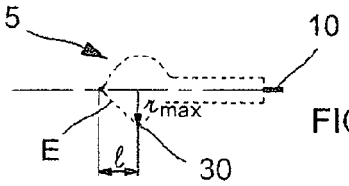

For example, in a plane of longitudinal section, the envelope surface can present, along its portion where the cross-section varies, an outline that is substantially semi-circular on one side of the core, and substantially triangular on the other side of the core, as shown in FIG. 11.

The maximum radius $r_{max}$ can be defined by the substantially semi-circular portion or by the substantially triangular portion, for example.

Figure 12:
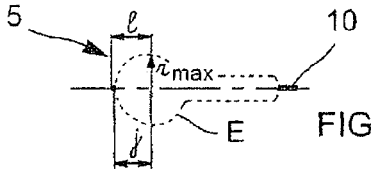

In the FIG. 12 embodiment, the portion of varying cross-section is substantially spherical and is connected to a cylindrical portion of circular cross-section.

Figure 13:
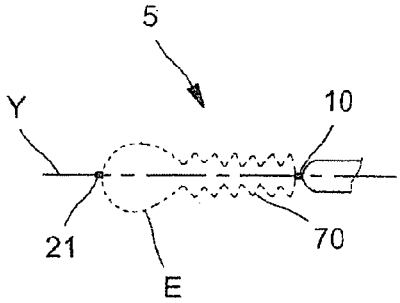

The applicator can also include a distal portion having an envelope surface that is substantially spherical, as shown in FIG. 13, and a proximal portion having a cross-section that varies, e.g. forming a succession of grooves or notches 70.

Figure 14:
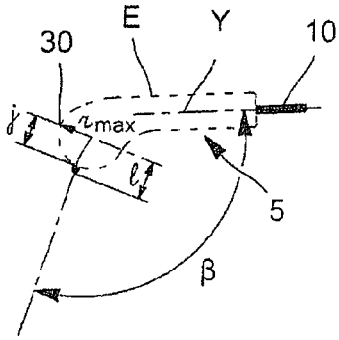

FIG. 14 shows the possibility of the core 10 extending along a longitudinal axis X that is not rectilinear but curvilinear, e.g. essentially being curved over its distal half.

The angle β formed between the axis of the core 10 at its proximal end and at its distal end lies in the range 1° to 90°, for example, better in the range 1° to 60°, still better in the range 1° to 20°, e.g. 7°.

The core 10 can be deformed after machining the bristles.

Figure 15:
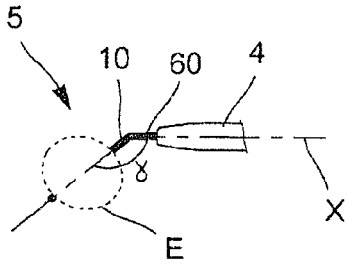

The core 10 can also be curved along its bare portion 60, as shown in FIG. 15. In this embodiment, the portion of the core carrying the bristles is rectilinear, and forms an angle γ with the longitudinal axis X of the stem, that lies in the range 10 to 30°, for example. In a variant not shown, the angled portion can also be situated flush with the stem 4.

The core 10 can be mounted in various ways on the stem 4, e.g. being inserted in a housing of the stem, e.g. by force-fitting, in particular when the core is a twisted metal core.

Figure 16:
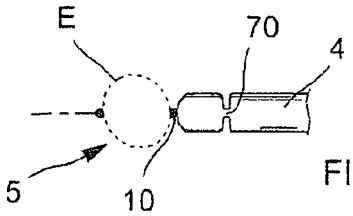
FIG. 16 shows the stem being made with a flexible portion.

As shown in FIG. 16, the stem 4 can include a portion 70 of increased flexibility that is suitable for flexing when the applicator is brought into contact with the eyelashes and/or when the applicator passes through the wiper member 8 on being removed from the receptacle 2.

By way of example, the zone of increased flexibility 70 is formed by stamping the stem and/or by a thin portion of said stem and/or by a portion of a material that is more flexible than the remainder of the stem.

The invention is not limited to a packaging and applicator device including only one applicator as described above.

Figure 17:
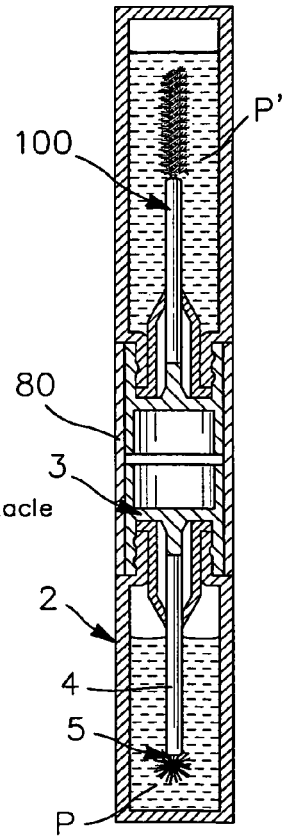
FIG. 17 shows another example of a packaging and applicator device constituting an embodiment of the invention.

By way of example and as shown in FIG. 17, the device can include a second applicator that is secured to the applicator 3 by means of a bushing 80, for example.

The second applicator 100 is provided with a brush, for example, possibly for applying a composition P' that can have the same formulation as the composition P contained in the receptacle 2, or it can have a different formulation, e.g. for applying to the eyelashes before applying the composition P or after applying said composition, or even presenting another color or enabling a different effect to be created.

In the embodiments described above, the applicator elements are bristles fitted to the core.

Variant embodiments of the invention are described below with reference to FIGS. 18 to 25, in which the applicator elements are integrally molded with the core and extend in a plurality of directions around the core.

Figure 19:
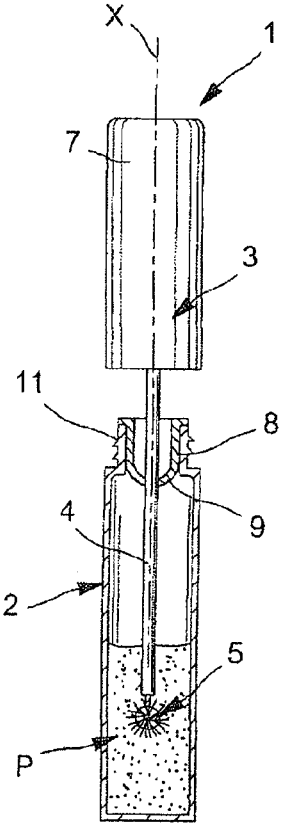
FIG. 19 is a diagrammatic and fragmentary longitudinal section showing another example of a packaging and applicator device constituting an embodiment of the invention.
Figure 22:
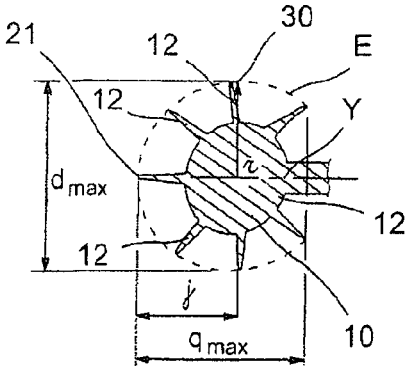
FIG. 22 is a diagrammatic and fragmentary longitudinal section of the FIG. 19 applicator.

FIG. 19 thus shows a variant embodiment of the packaging and applicator device, in which the applicator includes an injection-molded brush 5 at the end of the stem 4.

The distal end of the applicator can then be defined by at least one applicator element, as shown in the figure.

The applicator elements define an envelope surface E having a cross-section that increases, and then decreases, on going from the distal end to the proximal end of the applicator.

The applicator elements can be molded in the same material as the core. In a variant, the applicator elements and the core can be molded in different materials.

The applicator elements can be relatively thin, and can behave in a similar way to bristles fitted to a twisted core. In a variant, the applicator elements can be relatively stiff, and can form teeth.

In the example shown in FIGS. 19 to 22, each of the applicator elements extend in rectilinear manner, with some being oriented towards the distal end of the applicator, the applicator thus including applicator elements that are connected to the core in a direction that is not perpendicular to the longitudinal axis Y of the core.

The term "core" should be understood in a broad sense, and encompasses a core having a shape that is substantially spherical, for example, as shown.

Figure 21:
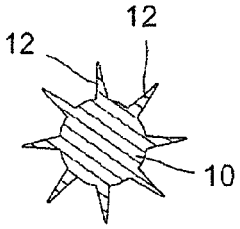
FIG. 21 is a cross-section on XX-XX of FIG. 19.

As shown in FIG. 21, the envelope surface E can present, over at least a fraction of its length, a cross-section of outline that is circular, at least in part. In a variant not shown, the envelope surface can present, over at least a fraction of its length, a cross-section that is polygonal, e.g. having more than five sides.

As shown, the envelope surface can be spherical to within 20%, at least in its portion extending from a plane where the transverse dimension defined by the envelope surface E is at its maximum, until it reaches the distal end 21.

As shown, the applicator can include applicator elements that are oriented towards the proximal end of the applicator.

The applicator can include applicator elements 12 that extend in more than four directions about the axis of the core, better that extend in at least eight directions about the axis Y of the core.

The applicator elements 12 can be arranged in rows that extend along the core, and that are equally spaced apart about the axis of the core.

In the embodiment shown, the core 10 is solid, but, in a variant not shown, it could be hollow.

As shown, the core 10 and the envelope surface E can pass via a maximum cross-section at a common axial position along the axis Y.

Figure 25:
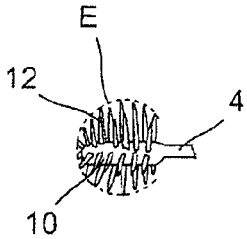
FIG. 25 shows a variant embodiment of the applicator.

In the variant shown in FIG. 25, the applicator elements present a height that varies, such that their free ends define the profile desired for the envelope surface E.

By way of example, the core 10 is elongate in shape, e.g. cylindrical, as shown.

The core 10 can be fitted to the stem 4, or, in a variant not shown, it can be integrally molded with the stem.

Figure 23:
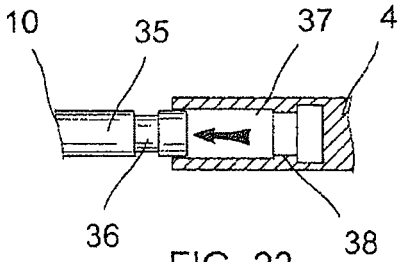
FIGS. 23 and 24 show examples of fastening the core on the stem.
Figure 24:
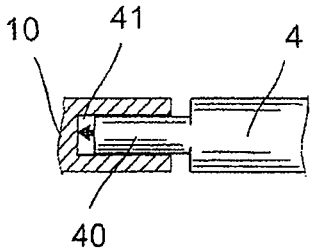

By way of example, the stem 4 includes a housing 37 that is provided with a portion in relief 38 for snap-fastening a proximal portion 35 of the core 10, said proximal portion being provided with a complementary snap-fastener portion in relief, e.g. in the form of a groove, as shown in FIG. 23. In a variant, as shown in FIG. 24, the stem 4 is made with a distal portion 40 that is fastened in a housing 41 formed at the proximal end of the core 10.

By way of example, the radius r of the envelope surface E can vary by less than 50% between one fourth and one half of the distance between the plane containing the peak ridge 30 and the distal end 21 of the applicator.

Figure 26:
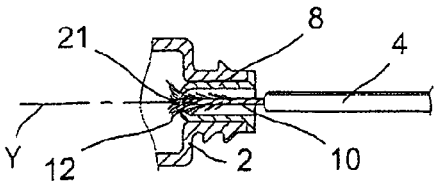
FIG. 26 shows an example of an applicator constituting an embodiment of the invention passing through the wiper member.

In some embodiments, when the applicator is loaded with composition on being inserted into a receptacle through a wiper member, the applicator elements can flex towards the distal end on removal of the applicator. The length of the applicator elements is preferably long enough to ensure that, while the applicator is passing through the wiper member, the applicator elements are flattened towards the distal end of the applicator. While flexing on passing through the wiper member, the free ends of some applicator elements can substantially reach the distal end of the core along the axis Y, as shown in FIG. 26, e.g. they can extend beyond the end.

Naturally, the invention is not limited to the embodiments described above.

In particular, the various embodiment characteristics of the above examples could be combined together within variants that are not shown.

For example, any of the brushes in FIGS. 8 to 13 could be made with a core that extends along a longitudinal axis that is curved.

The bristles could be of any kind and could present any section.

It is possible to use bristles presenting, in cross-section, a circular shape with or without a flat; a flat shape; a star shape, e.g. a cross shape or having a plurality of branches; a U-shape, an H-shape, a T-shape, or a V-shape; a hollow shape, e.g. circular or square, forming ramifications, e.g. snowflake-shaped; a prismatic shape, e.g. triangular, square, or hexagonal; or even oblong-shaped, in particular lens-shaped; or hourglass-shaped.

It is possible to use bristles having portions that are hinged to one another. It is also possible to use bristles that present at least one capillary channel.

Before being put into place on the core, the bristles could present an optionally rectilinear shape, e.g. an undulating shape.

The bristles could be subjected to a treatment that seeks to form beads or spikes at their ends.

The bristles could be natural or synthetic, and could, for example, be fabricated in a material selected from: polyethylene (PE); polyamide (PA), in particular PA6, PA6/6, PA6/10, or PA6/12; HYTREL®; PEBAX®; silicone; and polyurethane (PU); this list not being limiting.

Figure 27:
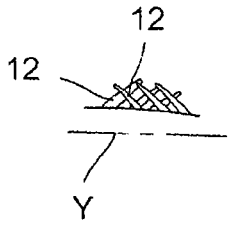
FIGS. 27 to 29 show a few examples of embodiment characteristics of the applicator elements.

The applicator could include a mixture of bristles, and the applicator elements, whether formed of bristles or of teeth, could overlap when the applicator is observed perpendicularly to the axis Y, as shown in FIG. 27.

It is possible to use flocked applicator elements or even applicator elements that are made by extruding or injection-molding a plastics material containing a filler of particles, e.g. particles of a moisture-absorbing material, so as to impart micro-relief to the surface of the applicator elements, or so as to give them magnetic or other properties.

The applicator elements, whether they are formed of teeth and/or of bristles, could thus be magnetizable.

The applicator elements could also be made with a material presenting properties that favors sliding.

The core could also be a double core, formed by two individual cores that are twisted together. Each individual core could comprise two strands that are twisted together, trapping bristles. Each of the two individual cores could be constituted by a branch of a single twisted core that is folded into a U-shape, the two branches being twisted together.

The applicator elements could be treated by contact with a hot surface and/or by stamping, in such a manner as to interrupt the spiral effect or to orientate the applicator elements in a circumferential direction around the core.

Notches could be made in the applicator, in particular when it is as a brush.

The applicator elements can be disposed in rows, e.g. aligned in meridians joining the distal and proximal ends of the core.

Figure 29:
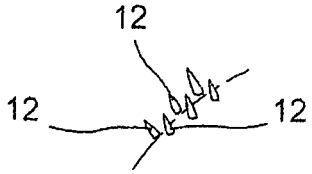
Figure 20:
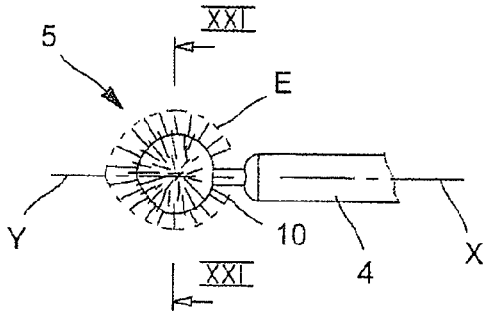
FIG. 20 is a diagrammatic and fragmentary view of the end of the FIG. 19 applicator.

Within any one row, the applicator elements could be in alignment, or they could be disposed in a staggered configuration, as shown in FIG. 29.

Figure 28:
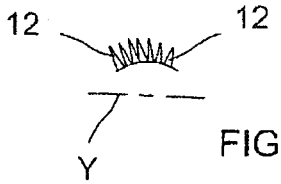

The applicator elements, in particular when they are teeth or bristles that are integrally molded with the core, could extend along the longitudinal axis with spacing that is constant or that varies, as shown in FIG. 28.

The expression "comprising a" should be understood as being synonymous with "comprising at least one" unless specified to the contrary. The expression "lying in the range" should be construed as including their limits.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A packaging and applicator device for applying a composition to eyebrows or eyelashes, comprising:

a receptacle provided with a wiper member;

a mascara composition contained in the receptacle;

an applicator for applying the composition, comprising a stem;

a core that extends along a longitudinal axis;

applicator elements carried by the core, the distal end of the applicator being defined by the core or by at least one applicator element;

the applicator elements defining an envelope surface; wherein:

the cross-section of the applicator defined by the envelope surface increases, and then decreases, on going towards the distal end of the core along at least two axes that are perpendicular to each other, and defines a peak ridge of maximum radius $r_{max}$ that is strictly the greatest radius for the entire envelope surface, the peak ridge being spaced apart from the distal end of the envelope surface by a distance measured along the longitudinal axis that is less than or equal to 1.5 $r_{max}$; and an angle $\alpha$ formed by slopes of the envelope surface on either side of the peak ridge in at least one longitudinal section being greater than 120°, the core being a twisted wire core or being molded with the applicator elements that present a height that varies.

2. A device according to claim 1, the envelope surface having a shape factor $r_{min}/r_{max}$ that is greater than 0.7, at least in a transverse plane containing the peak ridge.

3. A device according to claim 1, with the distance being $\leq 1.2\ r_{max}$.

4. A device according to claim 3, the angle $\alpha$ being greater than or equal to 130°.

5. A device according to claim 1, $r_{max}$ being greater than or equal to 2.5 mm.

6. A device according to claim 5, the number of turns in the portion of the core carrying the applicator elements lying in the range 7 to 12.

7. A device according to claim 1, the core being a twisted core, and the applicator elements being constituted by bristles.

8. A device according to claim 7, the core having a left-handed twist.

9. A device according to claim 7, the core having a right-handed twist.

10. A device according to claim 1, the core not being twisted.

11. A device according to claim 10, the applicator elements being integrally molded with the core.

12. A device according to claim 10, the applicator elements being fitted to the core.

13. A device according to claim 1, the envelope surface having a cross-section of outline that is circular, at least in part.

14. A device according to claim 13, the envelope surface having at least one cross-section that is completely circular.

15. A device according to claim 1, the envelope surface having a cross-section that is completely circular, at least in a plane containing the peak ridge.

16. A device according to claim 1, the envelope surface defining a radius r having a length that varies in non-linear manner between a proximal end of the envelope surface and the peak ridge.

17. A device according to claim 1, the envelope surface defining a radius r having a length that varies in non-linear manner between the peak ridge and the distal end of the envelope surface.

18. A device according to claim 1, the envelope surface, when observed from the side, having a rounded profile on either side of the peak ridge.

19. A device according to claim 1, the envelope surface presenting a distal portion that is at least partially spherical, to within 20%.

20. A device according to claim 1, the envelope surface presenting a proximal portion that is cylindrical.

21. A device according to claim 1, the envelope surface presenting a portion of cross-section that varies and a portion of cross-section that is constant, the portion of varying cross-section being of length that is less than the length of the portion of constant cross-section.

22. A device according to claim 21, the length of the portion of varying cross-section being less than or equal to one half of the length of the portion of constant cross-section.

23. A device according to claim 22, the length of the second portion lying in the range 6.5 mm to 35 mm.

24. A device according to claim 1, the core comprising a visible first portion that does not carry any applicator elements and that extends between a stem to which the core is connected and a second portion of the core carrying the applicator elements, the length of the first portion being greater than or equal to 5 mm.

25. A device according to claim 1, a distance from a transverse plane containing the peak ridge to the distal end of the applicator being less than or equal to 12 mm.

26. A device according to claim 1, the peak ridge being at a distance $r_{max}$ lying in the range 2.5 mm to 7.5 mm from the axis of the core.

27. A device according to claim 1, a portion of the core that does not carry applicator elements having an axis that is not rectilinear.

28. A device according to claim 1, the envelope surface being a surface of revolution.

29. A device according to claim 1, the envelope surface not being a surface of revolution.

30. A device according to claim 1, a portion of the core that carries the applicator elements not being rectilinear.

31. A device according to claim 1, the stem including a flexible portion that is suitable for flexing in use, and that is situated between the portion of the stem that is used for connecting to the core, and a portion of the stem that is connected to a handle.

32. A device according to claim 1, the length of the portion of the core carrying the applicator elements lying in the range 6.5 mm to 35 mm.

33. A device according to claim 1, the applicator elements being magnetizable.

34. A device according to claim 1, the applicator elements including a mixture of bristles.

35. A device according to claim 1, wherein the ratio $R_1=d_{max}/d_{core}$ is greater than or equal to 2.5, where $d_{core}$ corresponds to the diameter in which the cross section of the core is inscribed.

36. A device according to claim 1, wherein the ratio $R_2=d_{max}/d_{stem}$ is greater than or equal to 2.5, where $d_{stem}$ is the maximum diameter of the stem.

37. A device according to claim 1, wherein the ratio $R_3=d_{max}/P_{receptacle}$ is greater than or equal to 3, where $P_{receptacle}$ corresponds to the distance between a top of the receptacle when the applicator is absent and an internal surface of a bottom of the receptacle.

38. A device according to claim 1, the length of the applicator elements being long enough to ensure that, while the applicator is passing through the wiper member, the applicator elements are flattened towards the distal end of the applicator and cover the distal end of the applicator.

39. A method of applying makeup to the eyelashes and/or the eyebrows, the method comprising the steps of loading the bristles of an applicator in a device as defined in claim 1 with a composition for application to the eyelashes and/or the eyebrows, then in bringing the bristles thus loaded with composition into contact with the eyelashes and/or the eyebrows.

40. A method according to claim 39, the eyelashes being made up with at least the bristles of the applicator that are situated axially along the core between the peak ridge and the distal end of the applicator.

41. A method according to claim 39, in which, during application, the user turns the applicator about its own axis.

* * * * *